US006536991B1

(12) United States Patent
Trader et al.

(10) Patent No.: US 6,536,991 B1
(45) Date of Patent: Mar. 25, 2003

(54) METHOD OF STRUCTURALLY REINFORCING AN ASSEMBLY OF TUBULAR MEMBERS IN A MARINE ENVIRONMENT

(75) Inventors: Bruce Trader, Marriottsville, MD (US); George Hofmeister, Jr., Lafayette, LA (US)

(73) Assignee: Madcon Corporation, Ellicott City, MD (US)

( * ) Notice: Subject to any disclaimer, the term of this patent is extended or adjusted under 35 U.S.C. 154(b) by 0 days.

(21) Appl. No.: 09/689,292

(22) Filed: Oct. 11, 2000

(51) Int. Cl.[7] ..... F02D 5/60
(52) U.S. Cl. ..... 405/216; 405/211.1; 405/211
(58) Field of Search ..... 405/211, 211.1, 405/216, 195.1

(56) References Cited

U.S. PATENT DOCUMENTS

| | | | | | |
|---|---|---|---|---|---|
| 967,952 | A | * | 8/1910 | Moran | 405/216 |
| 2,373,885 | A | * | 4/1945 | Gast et al. | 405/216 |
| 3,736,759 | A | * | 6/1973 | Blose | 405/216 |
| 4,019,301 | A | | 4/1977 | Fox | 52/725 |
| 4,023,374 | A | | 5/1977 | Colbert et al. | 61/54 |
| 4,068,483 | A | | 1/1978 | Papworth | 61/54 |
| 4,114,388 | A | | 9/1978 | Straub | 405/216 |
| 4,116,013 | A | * | 9/1978 | Hellmers | 405/216 |
| 4,306,821 | A | | 12/1981 | Moore | 405/84 |
| 4,876,896 | A | | 10/1989 | Snow et al. | 73/827 |
| 4,892,410 | A | | 1/1990 | Snow et al. | 366/2 |
| 4,941,775 | A | * | 7/1990 | Benedict | 405/216 |
| 4,993,876 | A | | 2/1991 | Snow et al. | 405/216 |
| 5,591,265 | A | * | 1/1997 | Tusch | 405/216 |

FOREIGN PATENT DOCUMENTS

| | | | | |
|---|---|---|---|---|
| GB | 2255583 | * | 11/1992 | 405/216 |
| JP | 61-10634 | * | 1/1986 | 405/216 |
| JP | 61-155521 | * | 7/1986 | 405/216 |
| JP | 2-140322 | * | 5/1990 | 405/216 |

* cited by examiner

*Primary Examiner*—Frederick L. Lagman
(74) *Attorney, Agent, or Firm*—Garvey, Smith, Nehrbass and Doody, L.L.C.; Charles C. Garvey, Jr.

(57) ABSTRACT

A method and apparatus for structurally reinforcing a tubular member, or an assembly of tubular members in a marine environment is provided. The assembly includes a smaller diameter inner flow casing and a larger diameter outer conductor pipe, providing an annulus in between the flow casing and the conductor pipe. The method first dewaters the annulus places a plurality of lug anchor points in the annulus, in between the smaller diameter flow casing and the larger diameter conductor pipe. A volume of a first grout product is then pumped into the annulus at a selected lower elevational position. A volume of a second grout product is then pumped into the annulus at a position above the first grout product. A jacket is placed around the larger diameter conductor pipe, the jacket preferably being of variable diameter sections so that a larger upper section can receive a reinforcement cage. A reinforcement cage can be placed in between the larger diameter conductor pipe and the jacket. A volume of a third grout product is then pumped into the space in between the jacket and the larger diameter conductor pipe, wherein the third grout product encapsulates the reinforcement cage and bonds to both the conductor pipe and the jacket. A carbon fiber wrap can be wrapped spirally about the jacket and adhered thereto with adhesive or penetrant.

27 Claims, 6 Drawing Sheets

METHOD OF STRUCTURALLY REINFORCING AN ASSEMBLY OF TUBULAR MEMBERS IN A MARINE ENVIRONMENT

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus for repairing and structurally reinforcing piling, and in one embodiment, conductor pipes in a pipe within a pipe arrangement such as typically found in an offshore marine environment.

2. General Background of the Invention

In the offshore oil and gas well drilling industry, conductor arrangements are typically used as part of a marine platform. These conductor arrangements often include a smaller diameter inside pipe contained concentrically within the bore of a larger diameter outer pipe or conductor. The inner pipe is referred to as a flow casing. The outer pipe is referred to as a conductor.

Many of these conductors extend between the ocean floor and the rig deck or cellar area. These are areas of the platform that are above the water surface. However, the conductors and flow casings must necessarily interface with the water surface where they are subjected to wave action and corrosion because of the mix of salt water and air.

Other portions of an offshore marine platform that include horizontal members, diagonal members, and inclined members can also be subjected to environmental factors that corrode or mechanically erode these portions of the platform.

Patents have issued that relate generally to the concept of a method and apparatus for protective encapsulation of structural members.

One early patent is the Papworth patent 4,068,483 entitled "Protective Sheath for Water-Eroded Wood Piling". In the Papworth patent, the sheath is for a water-eroded wood piling. The sheath is a longitudinally split, flexible and resilient plastic casing with overlapping circumferentially end segments. The casing has a preformed, integral spout at its upper end into which wet concrete can be poured to fill the casing around the eroded section of the piling. Flexible bands clamp the casing tightly around the piling, and the spout has aligned openings in its opposite sides for passing the uppermost one of these bands. The casing may comprise two or more longitudinal sections in overlapped sealed engagement with each other end-to-end for enclosing a long eroded section of the piling.

In the Colbert patent 4,023,374, there is disclosed a repair sleeve for a marine pile and a method of applying same. The '1374 patent discloses a preformed molded fiberglass resin plastic repair sleeve for use on a marine or other submerged concrete pile and a method of applying the same. The sleeve is provided with at least one vertical seam consisting of inside interlocking reentrant bends which together establish an interlocking tongue and groove joint. The joint is maintained effective by self-tapping screws which are in engaged relation with steel closure clips or strips. The sleeve after assembly is centered about the pile undergoing repair and the continuous space which exists between the sleeve and the pile is filled with a suitable grout which, when hardened, encompasses the internal or inside portions of the joint under pressure and prevents unfastening of the seam. The vertical longitudinal extend of the sleeve is somewhat greater than the water depth of the partially submerged pile to which it is applied and, where a cylindrical concrete pile is concerned, the sleeve is molded on an arcuate bias so as to present an open gap enabling the sleeve to be readily slipped sidewise onto the pile by one or more divers and the gap thereafter closed in order to effect the interlocked joint. Where a square pile is undergoing repair, the sleeve assumes a conformable four-sided shape or, alternatively, it may be formed of two mating right-angle sleeve sections having a pair of vertical inside interlocking joints or seams between their adjoining side margins.

The Straub patent 4,114,388 discloses a device for protecting a pile from ice formations collecting on it and subsequently abstracting the pile as a result of a variation of tide level including a tapered guard member secured to the pile. The guard member is firmly secured to the pile by interconnecting stiffening members, horizontal stiffening rings, vertical fin members and compression rings which also serve to prevent deformation of the guard member taper as a result of interaction with the ice formations. The guard member comprises two sections connected by vertically extending tongue and groove joints.

The Moore patent 4,306,821 discloses a system for the restoring and reconditioning of structural piling. The system provides an outer form which is attachable to a portion of the piling which has been eroded or corroded and has lost some of is thickness and thus its overall strength. A diameter building filler is placed into the intraform space between the form and the piling, the filler providing a protective and structural coating to that portion of the piling where corrosion or damage has taken place. In the preferred Embodiment, the filler is a setting material such as a suitable epoxy.

Three patents have issued to Richard Snow and Milton Ellisor. These patents include U.S. Pat. Nos. 4,876,896; 4,892,410; and 4,993,876. The '896 and '410 patents discloses a method and apparatus for forming an encapsulation or encasement about a structural member that is said to be suited for use in a marine environment. A two-component polymer system for protective and repair encapsulation is pumpable in two separate strings to the location of the structural member to be encapsulated. The two reactive components are combined in a static mixer immediately prior to be injected within the surrounding translucent jacket. By combining the reactive components immediately prior to use, premature setup is avoided and the resulting grout may be directed to flow upwardly in the jacket for enhancing final properties. By suitable coloring of the components, visual monitoring of the final mixing and distribution in the translucent form or jacket of the encapsulation material may be monitored. A field test for determining bond strength of the encapsulation polymer to the structural member is also disclosed in the '876 patent and in the '410 patent. The '896 patent discloses a method of testing protective encapsulation of structural members.

The above discussed patents all relate primarily to coatings for protecting against corrosive effects of the surrounding marine environment. However, the prior art fails to address a problem of structural reinforcement for structural members that have become weak because of the corrosive and/or mechanical effects of the surrounding environment. Further, these patented prior art systems do not address concentric, pipe within pipe configurations.

BRIEF SUMMARY OF THE INVENTION

The present invention provides an improved method of structurally reinforcing a single tubular member (in one embodiment) and an assembly of tubular members (in another embodiment) in a marine environment. The single tubular member (in the first embodiment) can be a pipe, pile, brace or beam at the waterline. The assembly including a smaller diameter flow casing inside of a larger diameter conductor pipe, providing an annulus in between the flow casing and the conductor pipe.

For an assembly of tubular members, the method includes first placing a plurality of lug anchor points in the annulus, in between the smaller diameter tubular member (eg. flow casing) and the larger diameter tubular member (eg conductor pipe). The annulus is dewatered to a desired elevation, using a suction pump line attached to one of the ports 14.

A volume of a first grout product (eg. urethane grout) is then pumped into the annulus at a selected, lower elevational position. The first grout product forms a floating plug.

A volume of a second grout product ((eg. polymeric, epoxy, or cementitious, preferably epoxy) is then pumped into the annulus at a position above the first grout product.

A jacket (eg. fiberglass, a composite, plastic) is then placed around the larger diameter conductor pipe.

A reinforcement cage can optionally be placed in between the larger diameter conductor pipe and the jacket.

A volume of a third grout product (eg. polymeric, epoxy or cementitious, preferably epoxy) is then pumped into the space in between the jacket and the larger diameter conductor pipe. The third grout product encapsulates the reinforcement cage, and also forms a bonded interface to both the outside surface of the larger diameter conductor pipe and the inside surface of the jacket.

The jacket preferably has multiple sections of differing respective diameters. The jacket can be plastic, fiberglass or a composite.

The jacket can have a larger diameter upper section and a smaller diameter lower section, the reinforcement being positioned next to the larger diameter upper section.

A seal can be placed at the bottom of the jacket, in between the jacket and outer surface of the larger diameter conductor pipe.

The reinforcement cage can include inclined portions and/or laterally extending portions. The reinforcement cage can be of a metallic construction such as of metallic wire including portions that are woven to form a matrix or cage that extends longitudinally and circumferentially around the conductor pipe. Alternatively, the reinforcement cage can be manufactured of plastic, carbon fiber or FRP.

The shear lugs can include a plurality of generally horizontally placed members. The shear lugs are preferably placed by supporting them from either one of the conductor pipe or the flow casing.

The lugs preferably extend radially from a position next to the flow casing to a position next to the conductor pipe.

In the preferred method, the first grout product is preferably a lighter weight, urethane grout. The second grout product is preferably a heavier grout product such as epoxy grout. The third grout product is preferably epoxy grout.

In another embodiment of the method and apparatus of the present invention, reinforcement of an assembly of an inner flow casing and an outer conductor pipe is accomplished without a reinforcement cage, wherein the annulus has been dewatered and a lower floating "plug" of a first grout product is positioned in the annulus between flow casing and conductor. A second, preferably heavier grout product is then placed above the plug.

A jacket is then positioned around the outer surface of the conductor pipe (see FIGS. 2–2A and 4–5). A third grout product is then injected into the space in between the jacket and the outer surface of the conductor. Optional standoffs can be used to space the jacket from the conductor pipe. A wrap (preferably carbon fiber) is then wrapped spirally around the jacket, adhered thereto with an adhesive or penetrant, and can be lowered into position if below the waterline.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
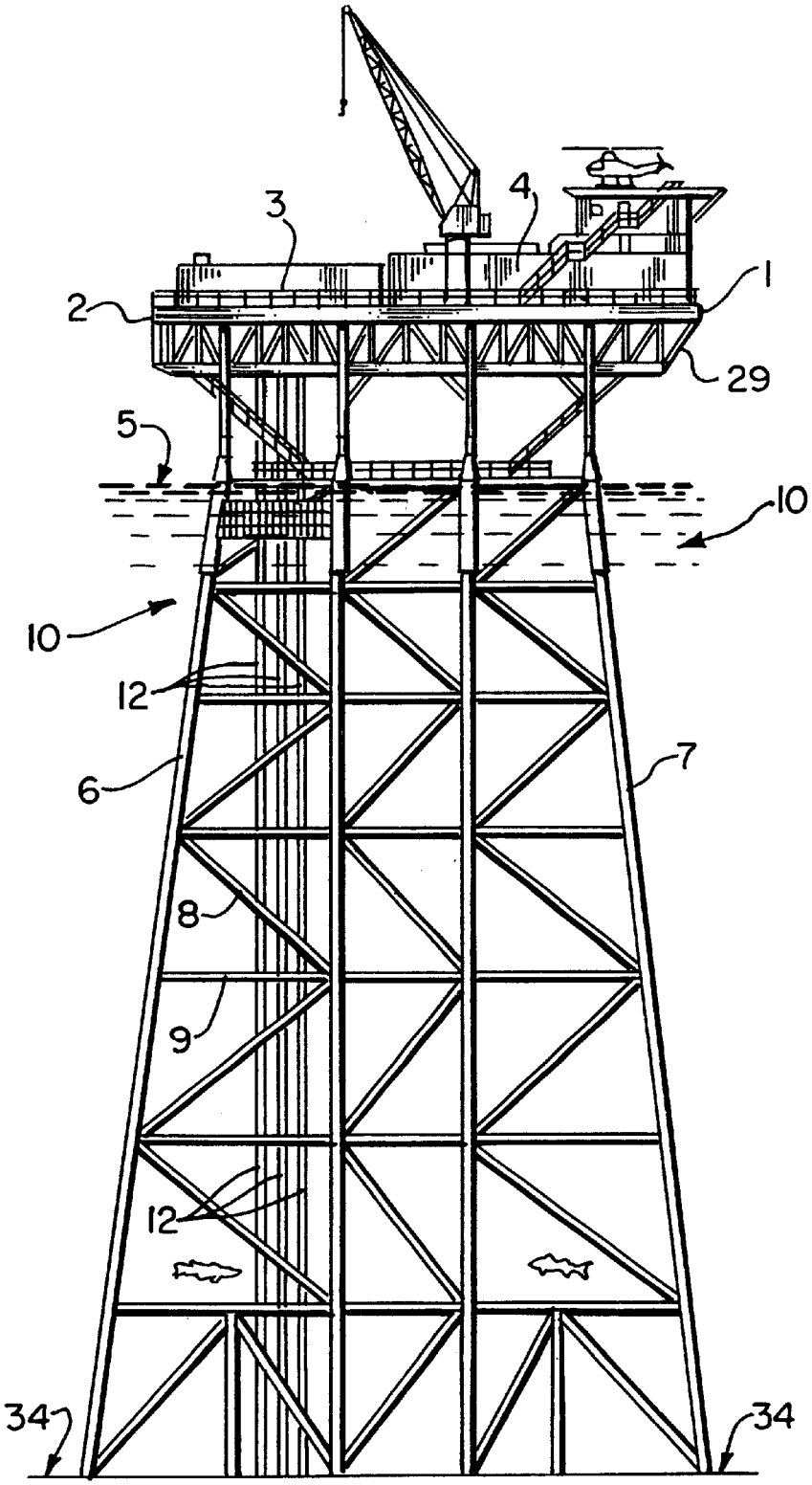
FIG. 1 is a schematic elevation view of an offshore platform showing a number of installations of the preferred embodiment of the apparatus of the present invention and illustrating the method of the present invention.

FIG. 1 shows the environment of the apparatus 10 and method of the present invention. In FIG. 1, there can be seen an example of an offshore marine platform that is commonly used in the oil and gas well drilling and production industry. Offshore platform 1 has a super structure 2 that includes a reinforced deck 3, any number of facilities 4 such as crew quarters, drilling equipment, production equipment and a substructure 6 that extends from the seabed 34 to the water surface 5.

The substructure 6 can be comprised of a plurality of welded steel members that include inclined members 7, diagonal members 8, and horizontal members 9. The encapsulation apparatus 10, 10A of the present invention and the method can be used to structurally reinforce and/or coat and protect such members 7, 8, 9, especially in a marine environment at the waterline 5.

Figure 8:
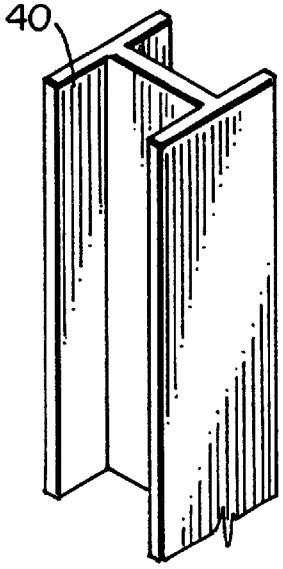
FIGS. 8–11 show alternate shapes of elongated structural members that can be the subject of the repair and reinforcement method and apparatus of the present invention.
Figure 9:
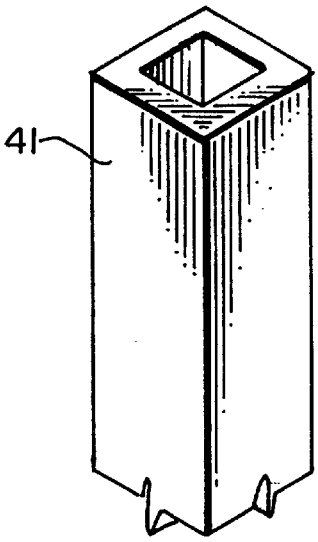
Figure 10:
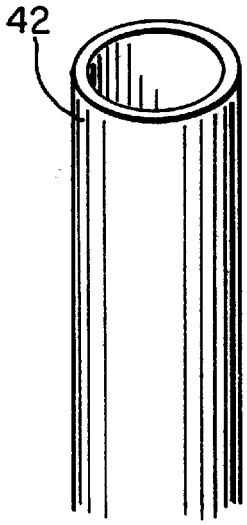
Figure 11:
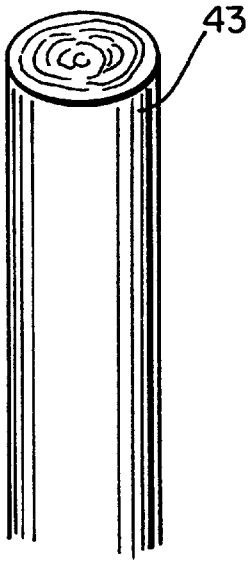

In FIGS. 2 and 4–6, a first embodiment of the apparatus of the present invention is shown, designated generally by the numeral 10. In FIGS. 2 and 4–6, a single tubular member such as member 6, 7 or 8 is being reinforced. However, the method and apparatus 10 shown in FIGS. 1, 2–2A, and 4–6 can also be used to reinforce and protect any of the members shown in FIGS. 8–11, including H-pile 40 (FIG. 8), square tubing 41 (FIG. 9), pipe 42 (FIG. 10) or timber pile 43 (FIG. 11). Also, the various method steps of the method of the present invention are shown in those FIGS. 2 and 4–6 and described hereinafter. In FIGS. 2 and 4–6, there can be seen a smaller diameter flow casing 11 contained concentrically within a larger diameter conductor 12. The conductor 12 has an outer surface 13. An annulus 17 is formed between the flow casing 11 and conductor 12.

As part of the method of the present invention, surface preparation of the exterior surface 13 of the outer conductor pipe 12 utilizes eg. water or grit blasting or mechanical abrading above and below the water surface 5 for a selected member 7, 8, 9 to be repaired. The outer conductor pipe 12 is then tapped with a plurality of injection ports or openings 14 that enable the annulus 17 to be dewatered and for a selected grout product(s) 16, 21 to be added to the annulus 17.

Figure 6:
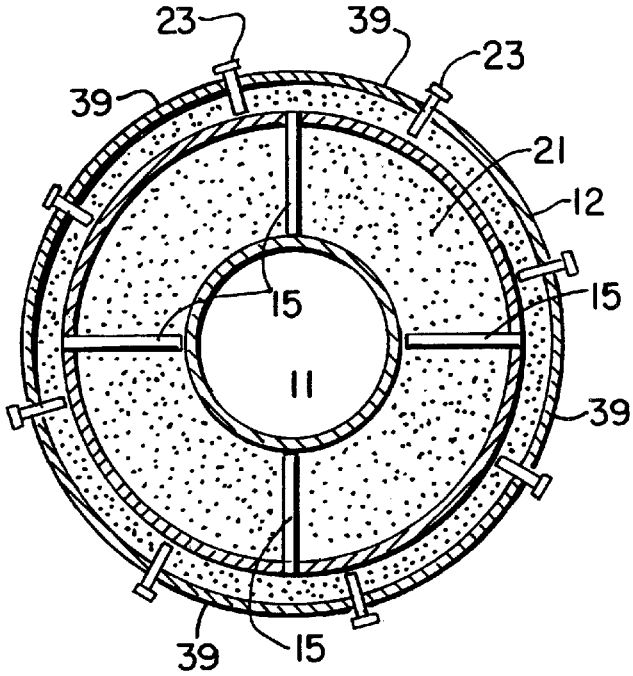
FIG. 6 is a fragmentary top sectional view illustrating the method and apparatus of the present invention.
Figure 5:
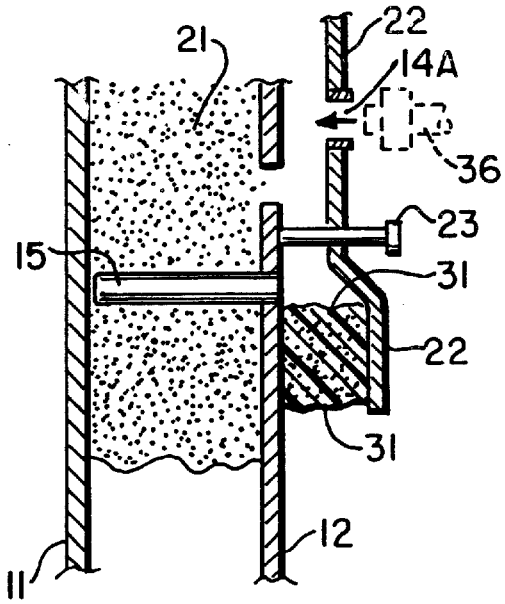
FIG. 5 is a fragmentary sectional elevation view illustrating the method of the present invention.
Figure 7:
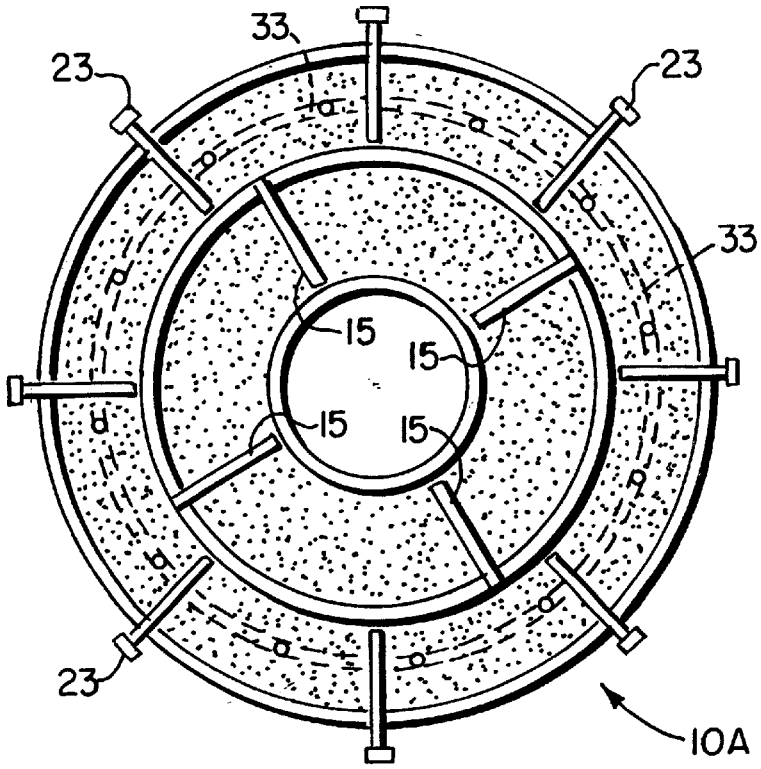
FIG. 7 is a top, sectional view illustrating the second embodiment of the apparatus of the present invention and the method of the present invention.

A plurality of shear lug, 15 are preferably installed, extending radially in the annulus 17 (see FIGS. 6–7). The mechanical shear lugs 15 are preferably mounted to the conductor pipe 12 by drilling and tapping the conductor pipe wall and fastening the mechanical shear lugs 15 thereto. The mechanical shear lugs 15 provide mechanical anchor points for grout that will be pumped into the outer conductor 12/inner flow casing 11 annulus 17. The annulus 17 is dewatered above and below the waterline, selected distances.

Figures 2, 3:
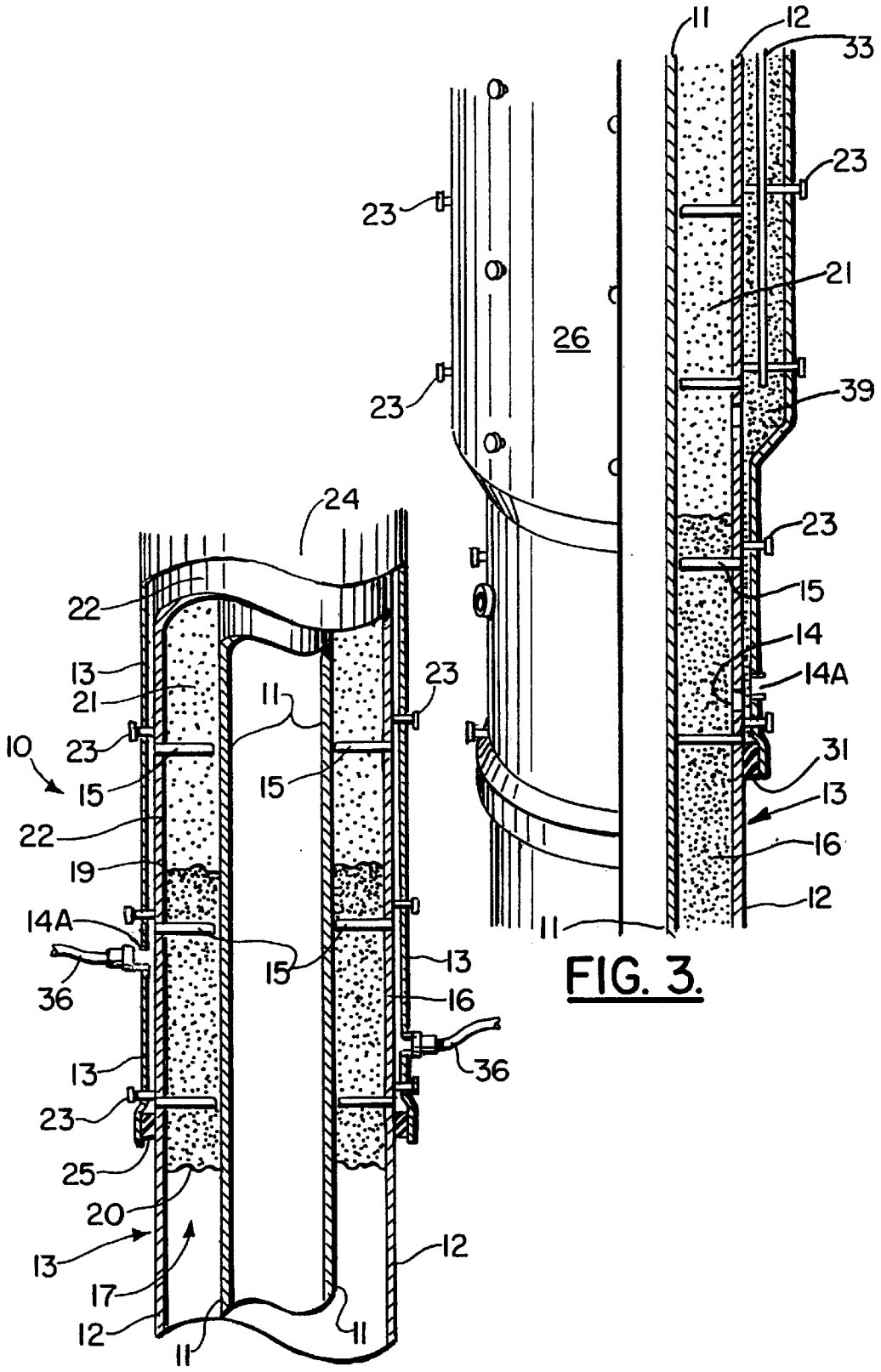
FIGS. 2–2A are elevation views of a first embodiment of the apparatus of the present invention and illustrating the method of the present invention.
FIG. 3 is a perspective, cut away view illustrating a second embodiment of the apparatus of the present invention and showing the alternate method of the present invention.
Figure 2A:
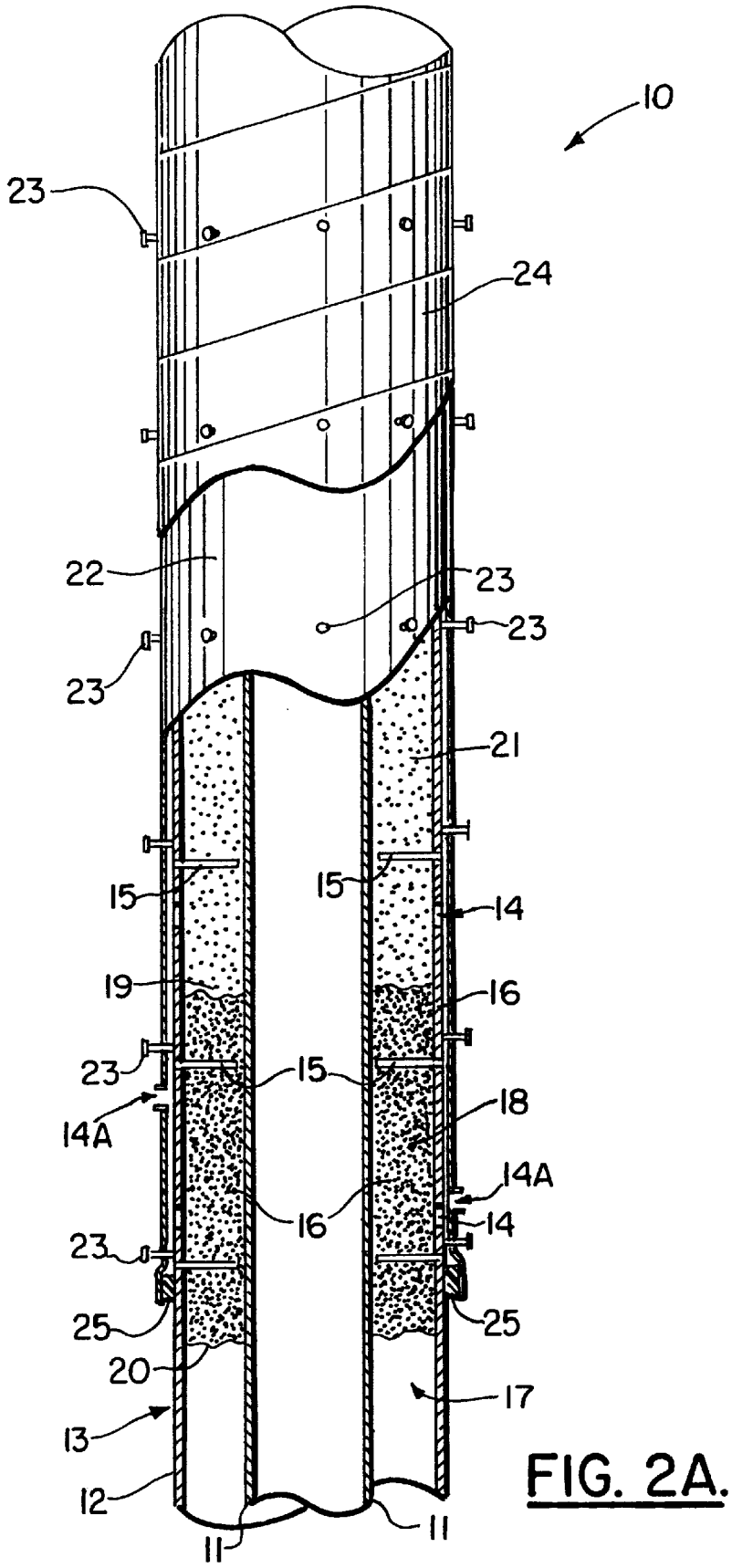
Figure 3A:
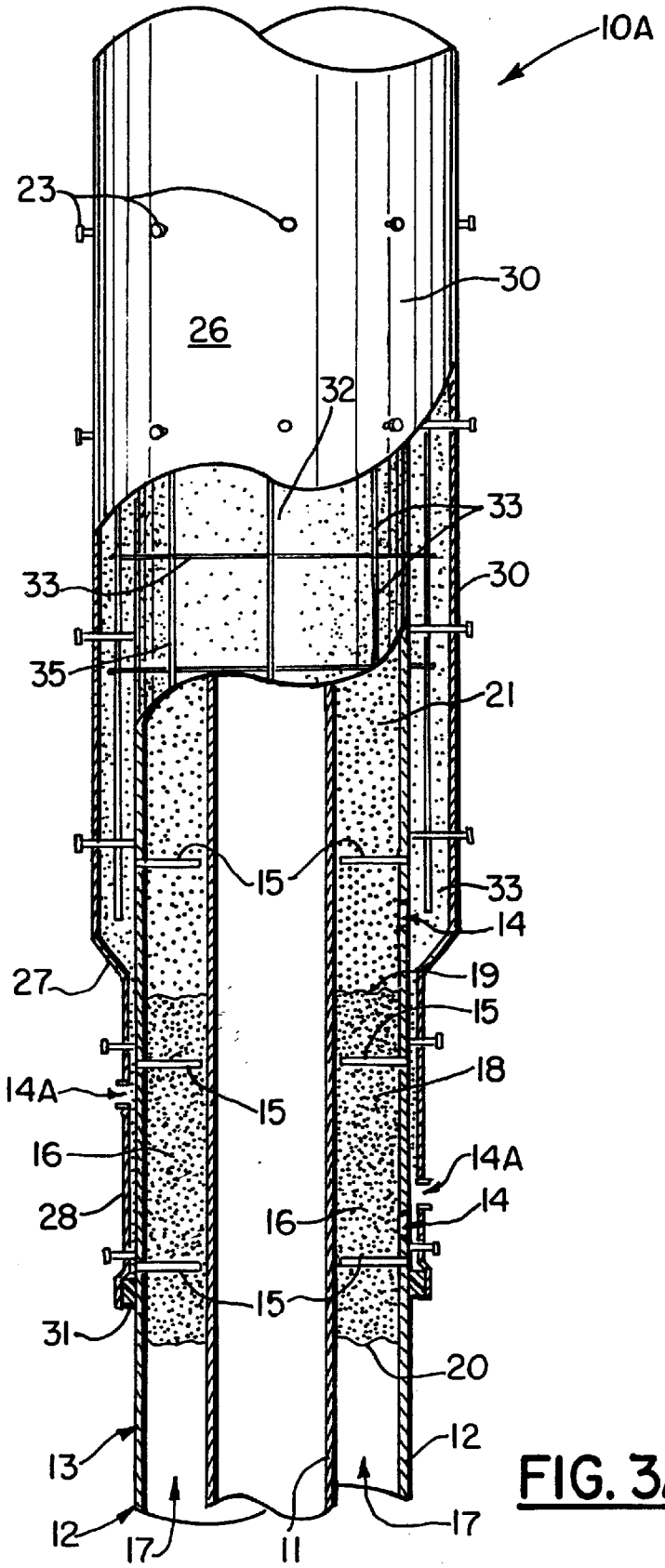
FIG. 3A is a partially cut away view illustrating an alternate embodiment of the apparatus of the present invention.
Figure 4:
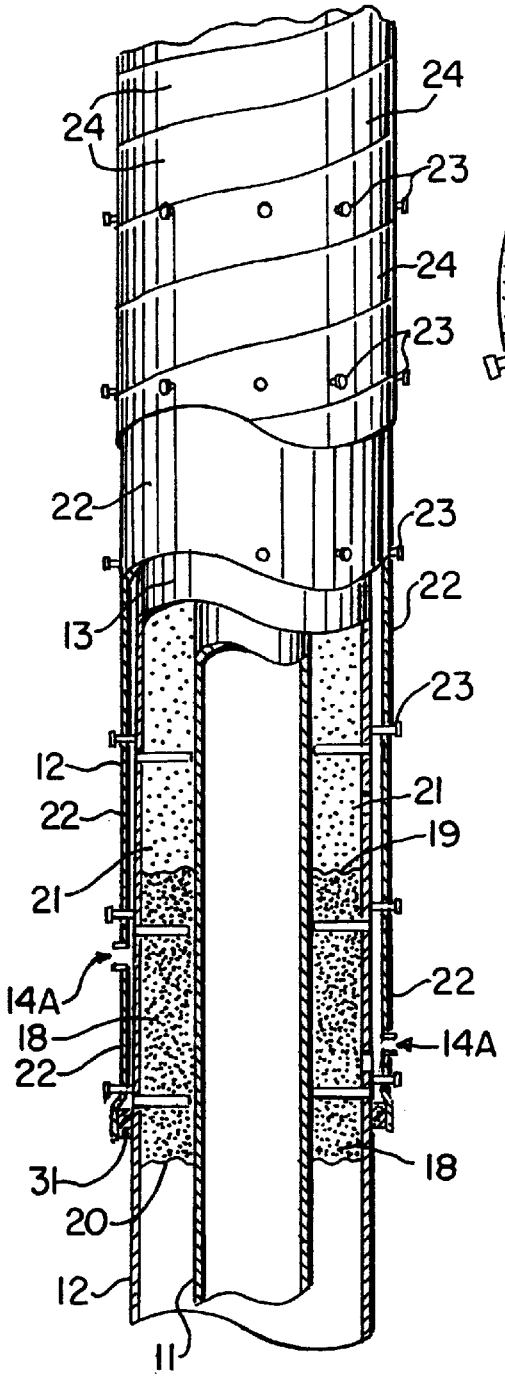
FIG. 4 is an elevation, partially cut away view of the first embodiment of the apparatus of the present invention.

A first grout product 16 is pumped approximately a few feet thick into the annulus 17 at the lower end portion of the casing 11 and conductor 12 to be repaired. The first grout product 16 is preferably a light, urethane grout that forms a "floating plug" 18. Plug 18 prevents having to grout the interior annulus 17 all the way down to the mud line or seabed 34. The floating plug 18 has a top 19 and bottom 20 as shown in the drawings. This plug 18 has been set as shown in FIGS. 2, 2A and 4. A second grout product 21 is then pumped into the outer conductor-inner casing annulus 17 so that it rests upon and communicates with the top 19 of the urethane grout plug 18 and extends up to the wellhead or cellar deck 29 of platform 1. An epoxy grout product 21 is preferred for the second grout product 21 because it achieves higher bond Capacities than cementitious grouts.

A jacket 22 is then placed around conductor 12, spaced radially therefrom using spacers 23 if desired to maintain uniformity. The jacket has a lower seal 25 to prevent grout from exiting the jacket. A third grout product 39 (preferably epoxy grout) is injected via one or more ports 14 into the space between jacket 22 and outer surface 13 of conductor 12. Conduits 36 can be used to pump grout to ports 14A in jacket 22 (see FIGS. 2 and 4).

An additional covering brace or wrap 24 can be positioned about the jacket 22 before or after grouting is completed. If the jacket 22 is to be placed underwater, the wrap 24 can be attached preliminarily to jacket 22. Brace or wrap 24 is preferably a carbon fiber wrap that is secured to the outside surface of jacket 22 using an adhesive or penetrant.

A plurality of stand offs 23 can optionally be provided to control spacing between outer conductor pipe 12 and jacket 22 as well as the spacing and placement of the wrap or brace 24.

In FIGS. 3 and 7, a second embodiment of the encapsulation apparatus of the present invention is disclosed, designated generally by the numeral 10A. In FIG. 3, jacket 30 provides a larger diameter upper section 26, a smaller diameter lower section 28, and a tapered transition section 27. Bottom seal 31 prevents downward movement of grout product below the lower end portion of jacket 30.

A plurality of injection ports 14, 14A are provided in the embodiment of FIG. 3 as they were in the embodiment of FIGS. 2 and 4–6. Injection ports 14 are drilled and tapped through the outer conductor 12. Injection ports 14A are provided through jacket 30. Reinforcement cage 33 is preferably comprised of a plurality of longitudinally extending (eg. vertical, near vertical or inclined) members 32 and laterally extending members 35. These members 32, 35 can be woven together or welded together to form a matrix of reinforcing material. Wire reinforcing 33 extends longitudinally and circumferentially about outer conductor pipe 12 at a position above smaller diameter section 28 of jacket 30. Reinforcement cage 33 provides reinforcing for lateral loads such as heavy sea conditions.

A conduit such as 36 shown in FIGS. 2 and 6 can be used to communicate with the selected injection ports 14, 14A for adding grout product during the method of the present invention.

In FIGS. 3 and 7, a first grout product such as urethane grout 16 first forms a plug 18 at a selected lower elevational position. A second grout product 21 is then injected above the plug. The third grout product 39 is injected through selected ports 14A in jacket 30 to fill the space between jacket 30 and conductor 12 above lower seal 31.

The jacket 30 can be of a material that actually bonds to form a structural member with the adjacent grout product. Thus, jacket 30 can be of carbon fiber, plastic, or fiberglass.

Either jacket 22 or 30 can be translucent so that any void spaces can be viewed and removed as grout is added.

As a third embodiment of the apparatus of the present invention and a third embodiment of the method of the present invention, it should be understood that a single tubular member such as a conductor 12, inclined member 7, diagonal member 8, or horizontal member 9 could be repaired using the procedure as shown in FIGS. 2–2A, 4–6 and as described herein. If a single tubular member such as the conductor 12 shown were to be repaired, the repair would be as shown in FIGS. 2, 2A and 4–6 with the deletion of flow casing 11. Rather, the plug 18 would extend completely across the internal bore of the selected tubular member 12 or 7, 8, 9. Similarly, the grout product 21 would extend fully across the internal bore of the member 12 or 7, 8, 9. In such a situation, the plug 18 would be comprised preferably of a grout product 16 such as a polymeric (for example urethane) grout. The grout product 21 would preferably be a polymeric, epoxy or cementitious grout product. All of the components and grout product applied to the outer surface 13 of conductor 12 (or member 7, 8, 9) would be the same as shown in FIG. 2, including jacket 22, grout product 39, reinforcement 33 (optional), or brace 24.

PARTS LIST

The following is a list of suitable parts and materials for the various elements of the preferred embodiment of the present invention.

| PART NO. | DESCRIPTION |
|---|---|
| 1 | offshore platform |
| 2 | super structure |
| 3 | deck |
| 4 | facility |
| 5 | water surface |
| 6 | substructure |
| 7 | inclined member |
| 8 | diagonal member |
| 9 | horizontal member |
| 10 | encapsulation apparatus |
| 10A | encapsulation apparatus |
| 11 | flow casing |
| 12 | conductor |
| 13 | outer surface |
| 14 | injection port |
| 14A | injection port |
| 15 | shear lug |
| 16 | grout |
| 17 | annulus |
| 18 | floating plug |
| 19 | top |
| 20 | bottom |
| 21 | grout |
| 22 | jacket |
| 23 | standoff |
| 24 | brace |
| 25 | bottom seal |
| 26 | larger diameter section |
| 27 | tapered transition section |
| 28 | smaller diameter section |
| 29 | cellar deck |
| 30 | jacket |
| 31 | bottom seal |
| 31 | bottom seal |
| 32 | inclined member |
| 33 | cage |
| 34 | seabed |
| 35 | laterally extending member |
| 36 | conduit |
| 37 | arrow |
| 38 | arrow |
| 39 | grout |
| 40 | H-pile |
| 41 | square tubing |
| 42 | pipe |
| 43 | timber pile |

The foregoing embodiments are presented by way of example only, the scope of the present invention is to be limited only by the following claims.

What is claimed is:

1. A method of structurally reinforcing an assembly of tubular members in a :marine environment, the assembly including a smaller diameter flow casing inside of a larger diameter conductor pipe, providing an annulus in between the flow casing and conductor pipe comprising the steps of:

a) placing a plurality of lug anchor points in the annulus, in between the smaller diameter flow casing and the larger diameter conductor pipe;

b) pumping a volume of a first grout product into the annulus at a selected, lower elevational position;

c) pumping a volume of a second grout product into the annulus at a position above the first grout product;

d) placing a jacket around the larger diameter conductor pipe;

e) placing a reinforcement cage in between the larger diameter conductor pipe and the jacket;

f) pumping a volume of a third grout product into the space between the jacket and the larger diameter conductor pipe; and g) wherein in step "f" the third grout product encapsulates the reinforcement cage.

2. The method of claim 1 wherein the jacket has multiple sections of differing respective diameters.

3. The method of claim 2 wherein the jacket has a larger diameter upper section and a smaller diameter lower section, the reinforcement cage being positioned next to the larger diameter upper section.

4. The method of claim 1 further comprising the step of placing a seal at the bottom end portion of the jacket, in between the jacket and the conductor pipe.

5. The method of claim 1 wherein the reinforcement cage includes inclined portions and laterally extending portions.

6. The method of claim 1 wherein the reinforcement cage includes metallic wire portions that are woven to form a metallic cage.

7. The method of claim 1 wherein the lug anchor points include a plurality of generally horizontally placed members and in step "a", the shear lugs are placed by supporting them from one of the conductor pipe or the flow casing.

8. The method of claim 1 wherein the lug anchor points include a plurality of generally horizontally placed members and in step "a", the shear lugs extend radially from a position next to the flow casing to a position next to the conductor pipe.

9. The method of claim 1 wherein the first grout product is a urethane grout.

10. The method of claim 1 wherein the first grout product is lighter than the second grout product.

11. The method of claim 1 wherein two of the grout products are of substantially the same grout material.

12. The method of claim 11 wherein the first grout product is lighter than the second grout product.

13. The method of claim 1 wherein the first grout product is a polymeric grout.

14. A method of reinforcement of an assembly of conductors in a marine environment, the assembly including a smaller diameter flow casing inside of a larger diameter conductor pipe, comprising the steps of:

a) placing a plurality of lug anchor points in the annulus between the smaller diameter flow casing and the larger diameter conductor pipe;

b) forming one of more openings in the wall of the larger diameter conductor pipe, each opening communicating with the annulus;

c) placing a jacket around the larger diameter conductor pipe;

d) pumping a volume of a first grout product into the annulus at a selected, lower elevational position;

e) pumping a volume of a second grout product into the annulus at a position above the first grout product;

f) placing a reinforcement cage in between the larger diameter conductor pipe and the jacket; and g) pumping a volume of a third grout product into the space between the jacket and the larger diameter conductor pipe.

15. The method of claim 14 wherein the jacket has multiple sections of differing respective diameters.

16. The method of claim 15 wherein the jacket has a larger diameter upper section and a smaller diameter lower section, the reinforcement cage being positioned next to the larger diameter upper section.

17. The method of claim 14 further comprising the step of placing a seal at the bottom end portion of the jacket, in between the jacket and the conductor pipe.

18. The method of claim 14 wherein the lug anchor points include a plurality of generally horizontally placed members and in step "a", the shear lugs are placed by supporting them from one of the conductor pipe or the flow casing.

19. The method of claim 14 wherein the lug anchor points include a plurality of generally horizontally placed members and in step "a", the shear lugs extend radially from a position next to the flow casing to a position next to the conductor pipe.

20. The method of claim 14 wherein the first grout product is a urethane grout.

21. The method of claim 14 wherein two of the grout products are of substantially the same grout material.

22. A method of reinforcement of an assembly of conductors in a marine environment, the assembly including a smaller diameter flow casing inside of a larger diameter conductor pipe, comprising the steps of:

a) placing a plurality of lug anchor points in the annulus between the smaller diameter flow casing and the larger diameter conductor pipe;

b) forming one of more openings in the wall of the larger diameter conductor pipe, each opening communicating with the annulus;

c) placing a jacket around the larger diameter conductor pipe;

d) pumping a volume of a first grout product through an opening in the jacket and then through an opening in the conductor pipe into the annulus;

e) pumping a volume of a second grout product into the annulus at a position above the first grout product;

f) placing a reinforcement cage in between the larger diameter conductor pipe and the jacket;

g) pumping a volume of a third grout product into the space between the jacket and the larger diameter conductor pipe; and h) wherein steps "d" through "g" are performed without first dewatering the space between the jacket and the conductor pipe.

23. A method of reinforcement of an elongated structural member in a marine environment, comprising the steps of:

a) placing a jacket around the elongated structural member;

b) placing a reinforcement cage in between the elongated structural member and the jacket;

c) pumping a volume of a grout product into the space between the jacket and the elongated structural member; and d) wherein the jacket has multiple sections of differing respective diameters; and e) wherein steps "b" through "c" are performed without first dewatering the space between the jacket and the elongated structural member.

24. The method of claim 23 wherein the jacket has a larger diameter upper section and a smaller diameter lower section, the reinforcement being positioned next to the larger diameter upper section.

25. The method of claim 23 further comprising the step of placing a seal at the bottom end portion of the jacket, in between the jacket and the elongated structural member.

26. The method of claim 23 wherein the reinforcement cage includes inclined portions and laterally extending portions.

27. The method of claim 23 wherein the reinforcement cage includes metallic wire portions that are woven to form a metallic cage.

* * * * *